US007887230B2

(12) United States Patent
Rosso et al.

(10) Patent No.: US 7,887,230 B2
(45) **Date of Patent: *Feb. 15, 2011**

(54) MIXER HAVING S-SHAPED PADDLES FOR MIXING VISCOUS MATERIALS

(75) Inventors: Aaron Charles Rosso, Chicago, IL (US); Matthew Earle Myers, Naperville, IL (US); Joseph Z. Wascow, Mundelein, IL (US); Brian A. Retzke, Chicago, IL (US); Salvatore C. Immordino, Jr., Trevor, WI (US); Terry L. Rosenstiel, Vernon Hills, IL (US)

(73) Assignee: United States Gypsum Company, Chicago, IL (US)

( * ) Notice: Subject to any disclaimer, the term of this patent is extended or adjusted under 35 U.S.C. 154(b) by 1110 days.

This patent is subject to a terminal disclaimer.

(21) Appl. No.: 11/607,244

(22) Filed: Dec. 1, 2006

(65) Prior Publication Data

US 2008/0130406 A1 Jun. 5, 2008

(51) Int. Cl.
*B01F 7/18* (2006.01)

(52) U.S. Cl. ..... 366/129; 366/325.5; 366/330.3; 366/331; 366/343

(58) Field of Classification Search ..... 366/129, 366/325.1, 325.4–325.5, 330.1–330.7, 331, 366/343, 342
See application file for complete search history.

(56) References Cited

U.S. PATENT DOCUMENTS

| | | | | |
|---|---|---|---|---|
| 656,123 | A | 8/1900 | Kempf | |
| 2,161,508 | A * | 6/1939 | Ensor et al. | 366/172.2 |
| 2,869,840 | A * | 1/1959 | Schmidt | 366/196 |
| 3,166,303 | A * | 1/1965 | Chapman | 366/129 |
| 3,251,579 | A | 5/1966 | Lasar | |
| 3,738,774 | A * | 6/1973 | Lutz | 416/210 R |
| 4,304,494 | A * | 12/1981 | Lutz | 366/343 |
| 4,479,721 | A * | 10/1984 | Rieger | 366/327.3 |
| 4,544,281 | A * | 10/1985 | Wilkinson | 366/330.1 |
| 4,627,735 | A * | 12/1986 | Rose et al. | 366/325.3 |
| 4,896,971 | A * | 1/1990 | Weetman et al. | 366/330.2 |
| 5,030,011 | A | 7/1991 | Kronberg | |
| 5,046,245 | A | 9/1991 | Weetman et al. | |
| 5,152,606 | A * | 10/1992 | Borraccia et al. | 366/331 |
| 5,326,168 | A | 7/1994 | Miura | |
| 5,382,092 | A | 1/1995 | Okamoto et al. | |

(Continued)

FOREIGN PATENT DOCUMENTS

EP 0063171 A2 * 10/1982

(Continued)

*Primary Examiner*—Charles E Cooley
(74) *Attorney, Agent, or Firm*—Greer, Burns & Crain, Ltd.; Pradip Sahu, Esq.; Philip T. Petti, Esq.

(57) ABSTRACT

A mixer is provided that is configured for attachment to a power tool for mixing a viscous material, and includes a shaft defining a shaft axis, and a plurality of paddles attached to the shaft and extending radially from the shaft. All of the paddles have generally the same axial distance to the first end of the shaft, and the paddles are configured for rotation about the shaft axis in a direction of rotation. Each of the paddles has a general "S"-shape defined between a top end and a bottom end of the paddle, and between a leading surface and a trailing surface of the paddle.

17 Claims, 4 Drawing Sheets

U.S. PATENT DOCUMENTS

| | | | | |
|---|---|---|---|---|
| 5,470,148 | A | 11/1995 | Gorr et al. | |
| 5,489,151 | A * | 2/1996 | Weber | 366/247 |
| 6,419,385 | B1 | 7/2002 | Walls | |
| 6,612,733 | B2 | 9/2003 | Schmidt et al. | |
| 7,131,765 | B2 * | 11/2006 | Backhaus | 366/149 |
| D566,143 | S * | 4/2008 | Rosso et al. | D15/138 |
| 7,374,333 | B2 * | 5/2008 | Eisenkraetzer et al. | 366/330.3 |
| D576,186 | S * | 9/2008 | Rosso et al. | D15/138 |
| 7,462,225 | B1 * | 12/2008 | Ketter et al. | 96/217 |
| 7,708,257 | B2 * | 5/2010 | Schmidt et al. | 261/84 |
| 2002/0176322 | A1 * | 11/2002 | Kupidlowski | 366/330.3 |
| 2003/0107950 | A1 | 6/2003 | Shepherd et al. | |
| 2004/0136263 | A1 * | 7/2004 | Backhaus | 366/291 |
| 2005/0259511 | A1 * | 11/2005 | Orton | 366/285 |
| 2008/0130406 | A1 * | 6/2008 | Rosso et al. | 366/342 |
| 2010/0135110 | A1 * | 6/2010 | Kwon | 366/331 |

FOREIGN PATENT DOCUMENTS

| | | | |
|---|---|---|---|
| JP | 6170202 | | 6/1994 |
| JP | 2002273188 | A * | 9/2002 |
| WO | WO 2004054697 | A1 * | 7/2004 |
| WO | 2010/082391 | A1 * | 7/2010 |

* cited by examiner

MIXER HAVING S-SHAPED PADDLES FOR MIXING VISCOUS MATERIALS

BACKGROUND OF THE INVENTION

The present invention relates generally to a mixer for mixing viscous fluids, and more particularly, to a mixer configured for attachment to a power tool for mixing viscous construction materials.

Mixers that are attachable to power tools for mixing viscous construction materials, such as cement and wallboard compound, are known. Conventional mixers typically have a shaft that is attachable to a power tool, such as a drill, and paddles that extend radially from the shaft. When the power tool is activated, the paddles rotate about the axis of the shaft to mix the viscous material.

Users of conventional mixers, such as drywall or wallboard finishers, use the mixer to stir or agitate wallboard joint compound before it is applied to the wallboard. Joint compound is a highly viscous fluid that is typically mixed at high mixer rotational velocities to have a thinner and smoother consistency so that it can be applied evenly. In many cases, water must be added to the joint compound to thin the mix, as well as to help the paddles of the mixer move through and fold the viscous material.

Conventional mixers have several disadvantages. Instead of achieving the desired radial and axial mixing of the viscous material, conventional mixers tend to only mix the viscous material radially relative to the mixer. Often times, when conventional mixers are held stationary, the added water is not folded into the material but instead stands on top of the material. To achieve a desired consistency, the user must manipulate the drill and displace the shaft at least in the axial direction. Further, achieving the desired consistency is inefficient with conventional mixers because a large amount of time is required to achieve the desired mixing of the material. Another disadvantage of conventional mixers is that there is significant operational vibration. When the paddles do not move evenly through the viscous material, the mixer and the container holding the viscous material vibrate. To prevent or lessen the vibration of the container, the user will often use their legs or feet to stabilize the container, often assuming an awkward or uncomfortable stance.

Also, the vibration of conventional mixers and of the container causes splattering of the material, and/or any standing water on top of the material. Thus, the user must use caution to prevent the splatter from landing on the work area. This condition is exacerbated when users run the mixers at higher speeds in rush situations.

A further problem with conventional mixers is that the relatively sharp-edged peripheral edges of the paddles operating at high speeds will contact the sides or bottom portions of the container, typically 5-gallon plastic pails, and "shave off" portions of the container, which contaminates the material. Further, such contact may cause the drill and mixer to jump back in the user's hands, disrupting the mixing operation.

Thus, there is a need for an improved mixer that more evenly mixes the viscous material.

There is also a need for an improved mixer with reduced vibration and splatter during use.

There is a further need for an improved mixer that reduces the amount of container-origin contaminants in the viscous material.

BRIEF SUMMARY OF THE INVENTION

The above-listed needs are met or exceeded by the present mixer that more evenly mixes viscous fluids such as wallboard joint compound, and which reduces the amount of vibration during use. The present mixer also reduces the possibility of contaminating the material with shavings from the material container.

More specifically, a mixer is provided that is configured for attachment to a power tool for mixing a viscous material, and includes a shaft having a first end and defining a shaft axis, and a plurality of paddles attached to the shaft and extending radially from shaft. All of the paddles have generally the same axial distance to the first end of the shaft, and are configured for rotation about the shaft axis in a direction of rotation. Each of the paddles has a general "S"-shape defined between a top end and a bottom end of the paddle, and between a leading surface and a trailing surface of the paddle.

In another embodiment, a mixer is provided that is configured for attachment to a power tool for mixing a viscous material, and includes a shaft having a first end and defining a shaft axis, and a plurality of paddles attached to the shaft. All of the paddles have generally the same axial distance to the first end of the shaft. The paddles extend radially from the shaft and are configured for rotation about the shaft axis in a direction of rotation. The paddles each have an outside surface along the length of the paddle, the outside surface including an extension portion that forms an outermost radial extent of the mixer, where the outermost radial extent is less than a full length of the outside surface. Each paddle has a general "S"-shape defined between a top end and a bottom end of the paddle, and between a leading surface and a trailing surface of the paddle. Also, each paddle forms a generally planar "T"-shape with a support arm forming a leg of the "T."-shape, and a blade having the "S"-shape and forming two arms of the "T".

In yet another embodiment, a mixer is provided that is configured for attachment to a power tool for mixing a viscous material, and includes a shaft having a first end and defining a shaft axis, and a plurality of identical paddles attached to the shaft and extending radially from the shaft. All of the paddles have generally the same axial distance to the first end of the shaft, the paddles being configured for rotation about the shaft axis in a direction of rotation. Each paddle has a first bottom surface forming the lowermost extent of the mixer, where the first bottom surface extends less than a full radial length of the paddle. Also, each paddle has a general "S"-shape defined between a top end and a bottom end of the paddle, and between a leading surface and a trailing surface of the paddle. Each paddle forms a generally planar "T"-shape with a support arm forming a leg of the "T"-shape, and a blade having the "S"-shape and forming two arms of the "T".

In a further embodiment, a mixer is provided that is configured for attachment to a power tool for mixing a viscous material, and includes a shaft having a first end and defining a shaft axis, and a plurality of paddles attached to said shaft and extending radially from the shaft. The paddles are configured for rotation about the shaft axis in a direction of rotation. Each of the paddles has a general "S"-shape defined between a top end and a bottom end of the paddle, and between a leading surface and a trailing surface of the paddle. Each of the paddles also forms a generally planar "T"-shape with a support arm forming a leg of the "T"-shape, and a blade having the "S"-shape forming the two arms of the "T". The blade has generally the same axial distance to the first end of the shaft.

DETAILED DESCRIPTION OF THE INVENTION

Figure 1:
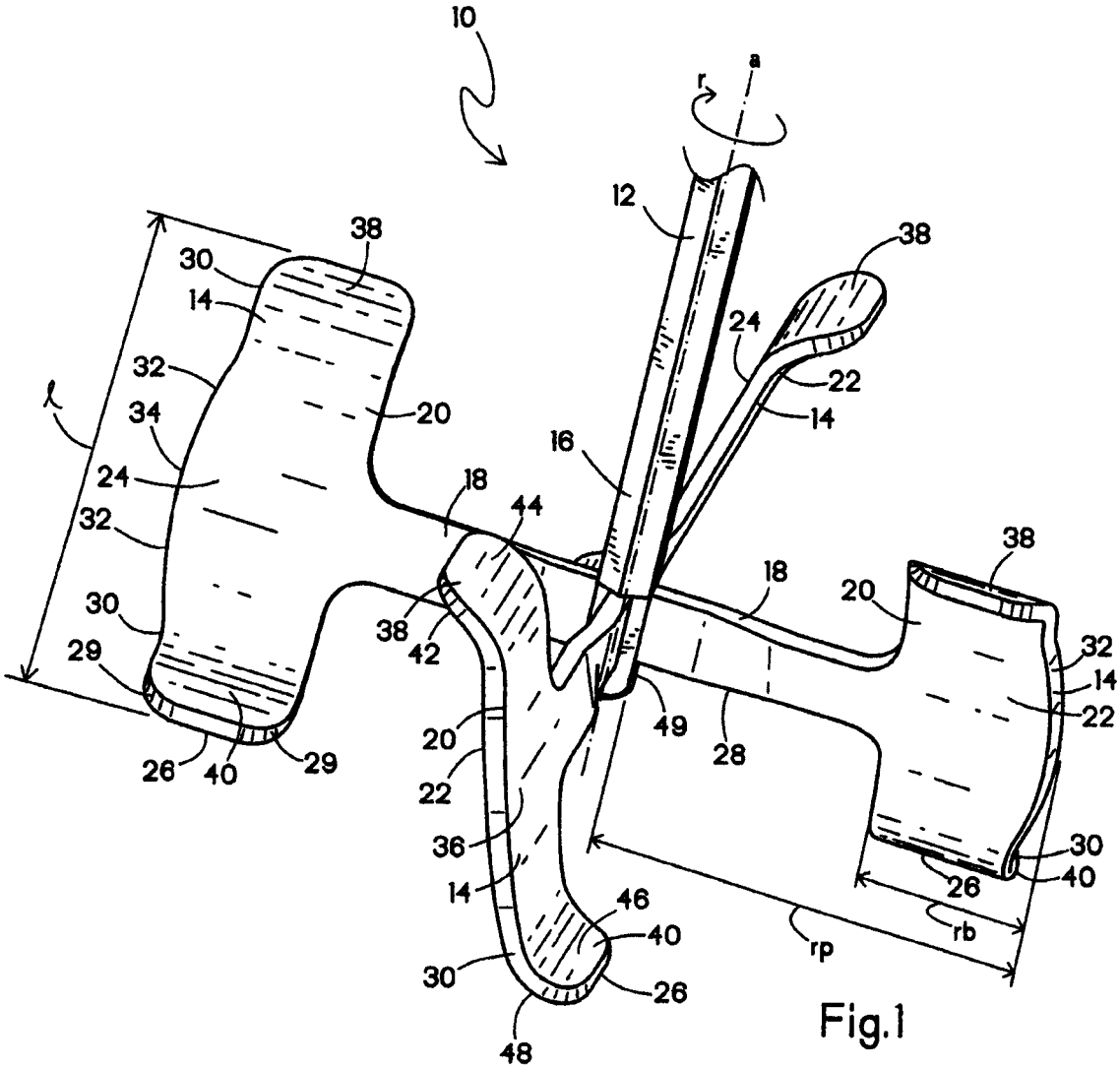
FIG. 1 is a partial top perspective view of the present mixer.
Figure 2:
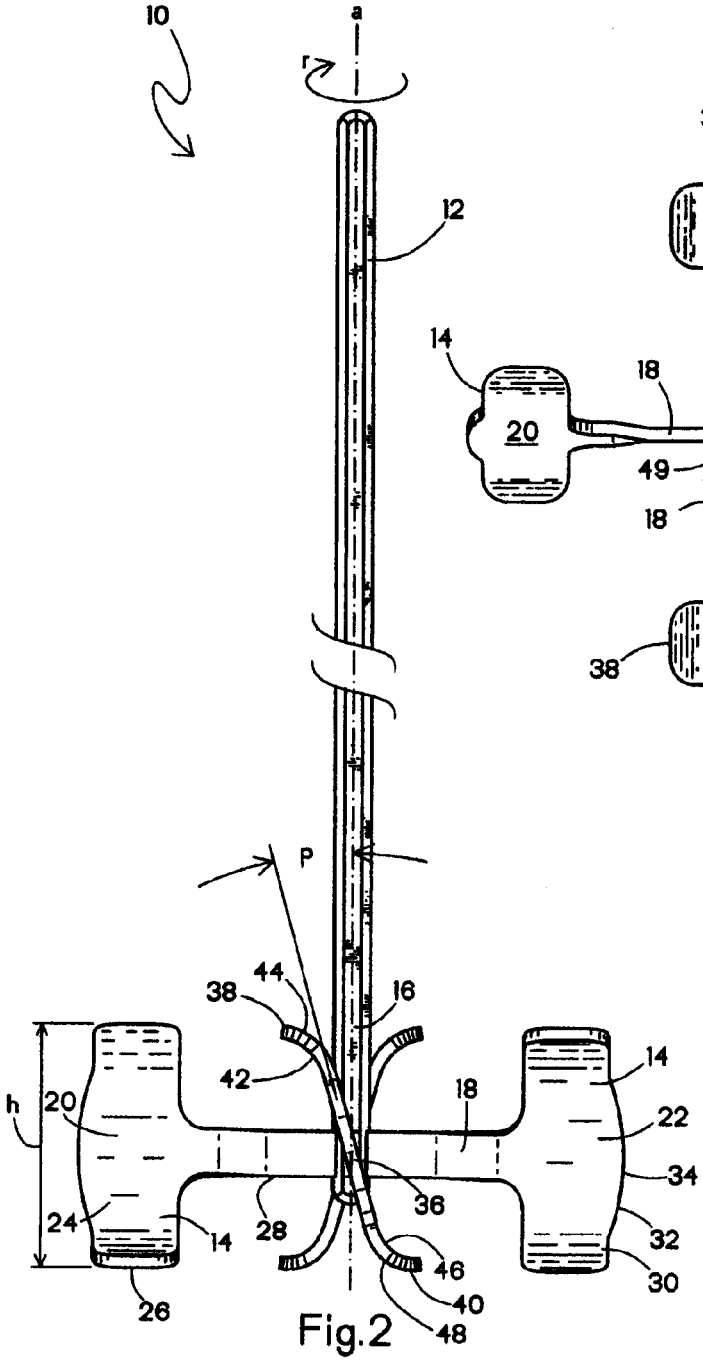
FIG. 2 is a front plan view of the mixer of FIG. 1.
Figure 3:
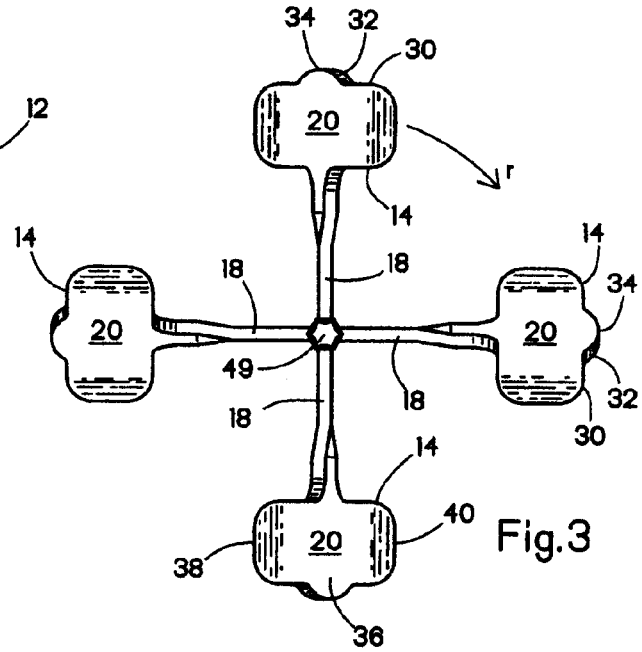
FIG. 3 is a top plan view of the mixer of FIG. 1.

Referring now to FIGS. 1-3, a mixer is designated generally at 10 and includes a shaft 12 and a plurality of paddles 14 extending radially from the shaft at a lower end 16. As is known in the art, the shaft 12 is engageable with a power tool (not shown), such as a drill. When the power tool is activated, the power tool rotates the shaft 12, and the paddles 14 rotate about a shaft axis "a". As such, it is preferred that the shaft 12 is noncircular, such as hexagonal, square or the like. If a cylindrical shaft is used, modifications may be needed to secure the paddles 14 to the shaft, and to retain the shaft in the tool, as is well known in the art. The paddles 14, which are placed into a container of viscous material (not shown), push the material out of the path of the paddle and cause the material to mix.

In the preferred embodiment, there are four paddles 14 that are spaced at about 90-degree increments 360-degrees around the shaft. Also, each of the four paddles 14 is identical in configuration, however, it is contemplated that a different number of paddles having similar or differing configurations or spacing can be used. Also, the paddles 14 project radially from the shaft 12 at a single point on the shaft, which in the preferred embodiment is at or adjacent to the lower end 16 of the shaft. It is also contemplated that the paddles 14 have generally the same axial distance to the end 16. Other locations on the shaft are also contemplated.

The preferred paddle 14 is generally "T"-shaped with a support arm 18 extending radially from the shaft 12 forming the leg of the "T"-shape, and a blade portion 20 extending generally perpendicularly from the support arm forming the two arms of the "T"-shape. Formed from a generally thin but rigid plate-like member, the blade portion 20 includes a first or leading surface 22, and a second or trailing surface 24 opposite the first surface. The blade portion 20 also includes a top end 38 and a bottom end 40, with the top end 38 curved toward the direction of rotation "r", and the bottom end 40 curved toward the opposite direction.

In the preferred embodiment, the power tool (not shown) that activates the mixer 10 is preferably configured to rotate the paddles in the direction of rotation "r". While the preferred direction of rotation "r" is indicated to be clockwise (as viewed from the top of the shaft 12), it is contemplated that the direction of rotation "r" can also be counterclockwise, however if rotation of the mixer 10 (as depicted in FIG. 1) is reversed from the preferred direction, the paddles 14 will not perform as efficiently. However, whether the preferred direction of rotation is clockwise or counterclockwise, it is preferred that the paddles 14 are configured such that the top end 38 is curved toward the direction of rotation "r", and the bottom end 40 is curved toward the opposite direction for enhanced efficiency. When the power tool activates the mixer 10, the first or leading surface 22 of the blade portion 20 faces the direction of rotation, and the second or trailing surface 24 of the blade portion faces the opposite direction.

In the general "T"-shape, a first bottom edge 26 extends along the radial length "rb" of the blade portion 20. A second bottom edge 28 on the support arm 18 is preferably offset in the axial direction from the first bottom edge 26 of the blade portion 20. The first bottom edge 26 is preferably linear with rounded or radiused corners 29, as well as cornered or rounded peripheral edges.

A length "rb" of the first bottom edge 26 is preferably less than half a radial length "rp" of the paddle 14, and further, is more preferably about a third of the radial length. With the first bottom edge 26 extending only along a portion of the radial length "rp" of the paddle 14, if the mixer 10 were to hit the bottom of the container, it is likely that only the first bottom edge 26 would contact the container given the preferred, generally vertical orientation of the mixer 10 with respect to the container during use. In this configuration, it is contemplated that the amount of "shavings" in the material is significantly reduced from the amount of "shavings" of conventional mixers where the bottom edge extends substantially along the entire radial length of the paddle.

On the other side of the blade portion 20 from the support arm 18 is an outside surface 30. Preferably, the outside surface 30 is non-linear, and in the preferred embodiment, the outside surface includes an extension portion 32 that is radially outwardly curved or convex along a portion of the length "l" of the blade portion 14. Preferably, the extension portion 32 extends along less than the entire length "l" of the blade portion 20, and further, an outermost radial extent 34 of the extension portion 32 extends preferably along less than a quarter of the length of the blade portion.

In contrast to the conventional mixer having a linear outside surface 30, due to the shape of the extension portion 32, the mixer 10 does not jerk or jump out of the hands of the user when the outermost radial extent 34 hits the side of the container during mixing. Instead, due to the shape of the outside surface 30, when contact is made with the side of the container, the mixer 10 is rebounded away from the sides of the container. Thus, the present mixer 10 has a greater capability than the conventional mixer to mix the material near the sides of the container. Further still, when the rounded, outermost radial extent 34 hits the container, it is likely that no portion of the container is "shaved off", eliminating the potential container contaminants in the viscous material. While the preferred embodiment is an outwardly curved extension portion 32 with an outermost radial extent 34 being on the curve, it is contemplated that other configurations in which the outermost radial extent is less than the length "l" of the blade portion 20 can be used.

The first surface 22 and the second surface 24 of the paddles 14 lay substantially in a plane that extends generally radial to the shaft. In this configuration, a majority of the surface area of the paddle 14 (at the first surface 22 and the second surface 24) is used to impart pressure on the viscous material regardless of the direction of rotation. In the preferred embodiment, a generally linear portion 36 of each paddle 14 has a slight pitch "p" (FIG. 2) of about 15-degrees. A preferred range of pitch is about 0 to 30-degrees, although the pitch can be larger or smaller.

Viewed in profile, the blade portion 20 forms a general "S"-shape from the top end 38 to the bottom end 40, with the generally linear portion 36 in between, and between the first surface 22 and the second surface 24. The top end 38 is curved toward the direction of rotation "r", and the bottom end 40 is curved toward the opposite direction. Preferably, the top end 38 is rounded to have a 0.7 inch radius at an inside surface 42, and a 0.9 inch radius at an outside surface 44. The bottom end 40 is preferably rounded to have a 0.5 inch radius at an inside surface 46 and a 0.7 inch radius at an outside surface 48. However, other dimensions of "S"-shaped paddles 14 are contemplated. Further, it is contemplated that the paddle 14 may have only one curved end, or alternately, may have additional curvature along the length "l" of the blade portion 20.

In operation in the direction of rotation, the "S"-shaped paddle 14 draws material from the top of the mix to the bottom by creation of a vortex. The top end 38 pushes the material downward, while the bottom end 40 pushes material upward to fold the material. In this configuration, the mixer 10 generates lift of the mixer itself, which resists the gravitational pull and the tendency of the mixer to rest on the bottom of the mixing container. Since the mixer 10 is less likely to rest on the bottom of the container, this also reduces the likelihood of contamination of the mix with shavings from the bottom of the container.

When the mixer 10 is operated in the opposite direction, and if the configuration of the paddles 14 is not changed, i.e. the bottom end 40 is curved toward the opposite direction and the top end 38 curved away from the opposite direction, then instead of generating lift, the mixer would push downward. For this reason, while the mixer 10 is operable to mix in both the clockwise and counterclockwise directions, it is preferable that the mixer be used in the direction that allows the top end 38 to be the leading end to generate lift.

Since the mixed material flows in a smooth vortex pattern, the material is less likely to spill outside of the container. When the material stays inside of the mixing container, the amount of mess in the workspace is significantly reduced.

It has been found that the combination of the mixer shape and the resulting vortex flow pattern tend to self-correct the alignment of the mixer with respect to the mixing container. Specifically, when the alignment of the shaft 12 of the mixer 10 is anti-parallel with the central axis of the container (generally a cylindrical bucket), the mixer tends to reorient itself to be parallel with the axis of the container during use.

The thickness of the paddle 14 from the first surface 22 to the second surface 24 is about 0.2 inches, however this dimension can be larger or smaller. The radial length "rl" of each paddle 14 is about 4 inches, and the height "h" of each blade portion is about 3.5 inches, however other dimensions are contemplated.

The paddles 14 and the shaft 12 are preferably made of alloy steel, cast materials, or any other material sufficiently rigid and sufficiently resistant to abrasion and corrosion for the application. While other shapes are contemplated, the shaft 12 is preferably hexagonal in cross-section. Preferably, the paddles 14 are assembled to the shaft 12 by welding to a hub 49 or to the shaft itself, however it is contemplated that they can be assembled by hard-soldering or any other technique.

Figure 4:
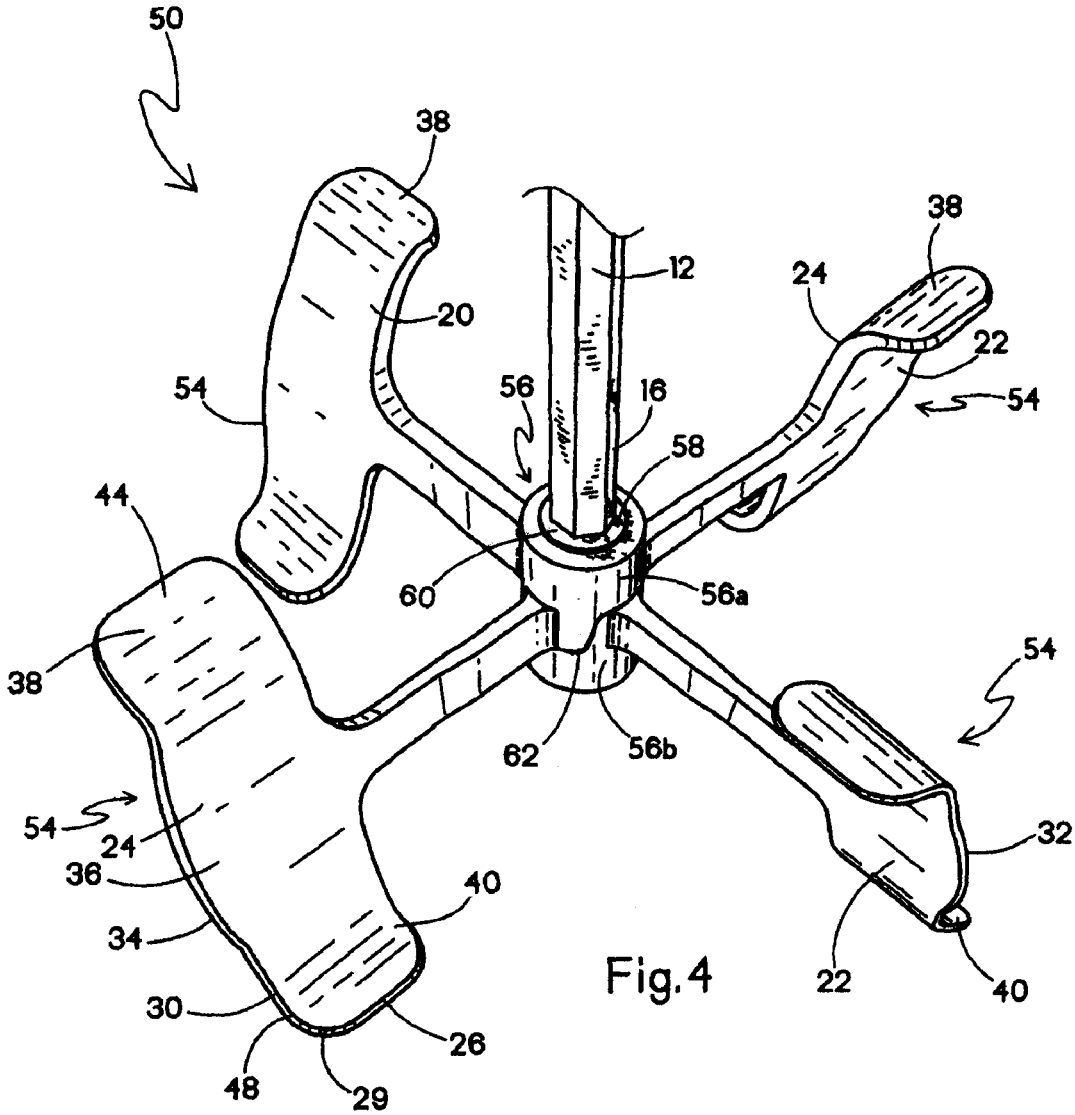
FIG. 4 is a fragmentary top perspective view of an alternate embodiment of the mixer of FIG. 1.

Referring now to FIG. 4, an alternate embodiment of the mixer 10 is generally designated 50. Components shared with the mixer 10 are designated with identical reference numbers. The main difference between the embodiments 50 and 10 is that the mixer 50 has its paddles 54 die cast in pairs, with members of each pair projecting diametrically opposite each other. Each pair of paddles 54 is connected to a central collar 56. The collar 56 has a noncircular bore 58 for receiving the shaft 12, or alternatively a noncircular bushing 60 is spaced between the shaft and the bore 58. Thus, the collar 56 must rotate with the shaft 12.

The collar 56 is made in two parts, 56*a*, 56*b*, each part associated with a pair of the paddles 54. Also, the collar 56 is configured so that each part 56*a*, 56*b* has a complementary nonplanar shape 62 for preventing relative rotation of said parts. In the preferred embodiment, the nonplanar shape 62 is relatively serpentine, and the two parts 56*a*, 56*b* mate or nest into each other to form a cylindrically configured collar. The collar parts 56*a*, 56*b* are secured to each other by a nut (not shown) located beneath the lower part 56*b* which threadably engages the end of the shaft 12.

Upon assembly, the paddles 54 are each oriented at 90-degree spacing relative to adjacent paddles. Also, despite a slight axial displacement, the paddles 54 on the two parts 56*a*, 56*b* are considered to have generally the same axial distance from the shaft end 16. Also, it is preferred that the collar 56 is crimped at its upper end about the shaft 12 for additional holding power.

Figure 5:
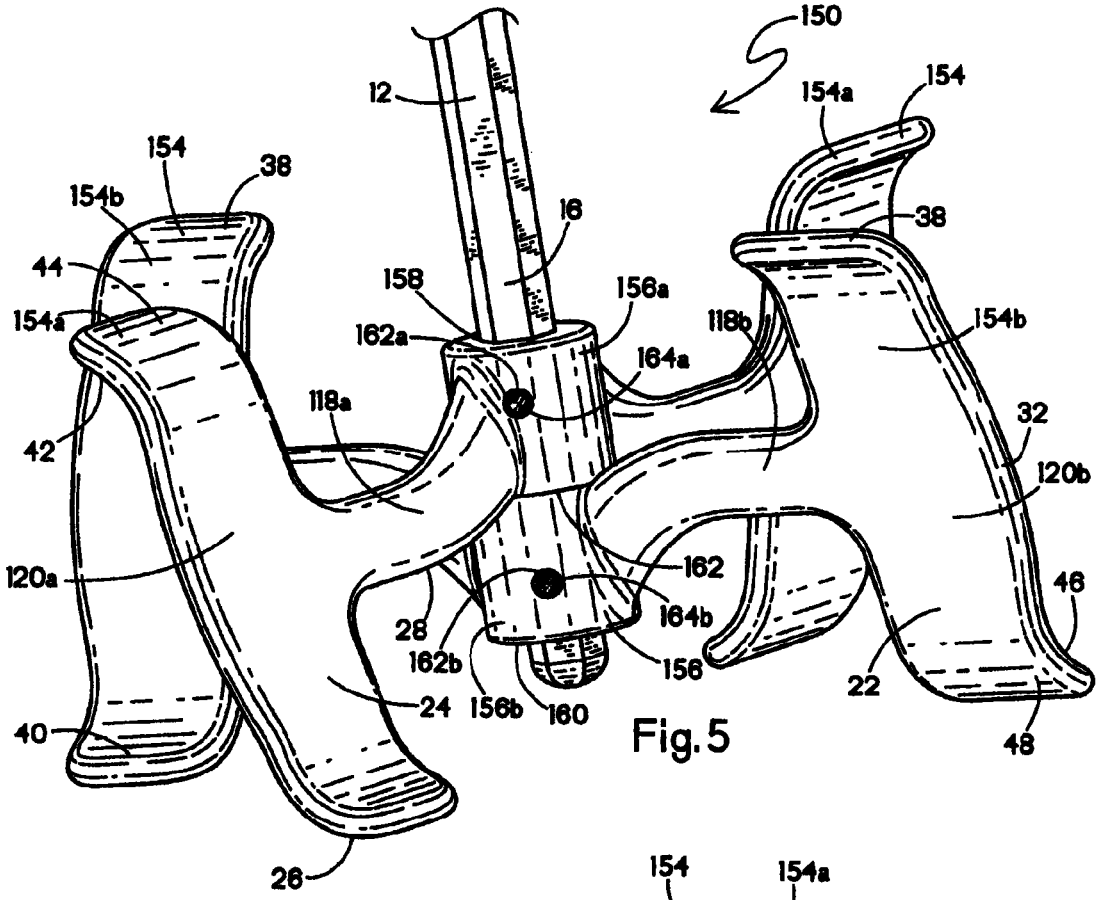
FIG. 5 is a fragmentary top perspective view of an alternate embodiment of the mixer of FIGS. 1 and 4.
Figure 6:
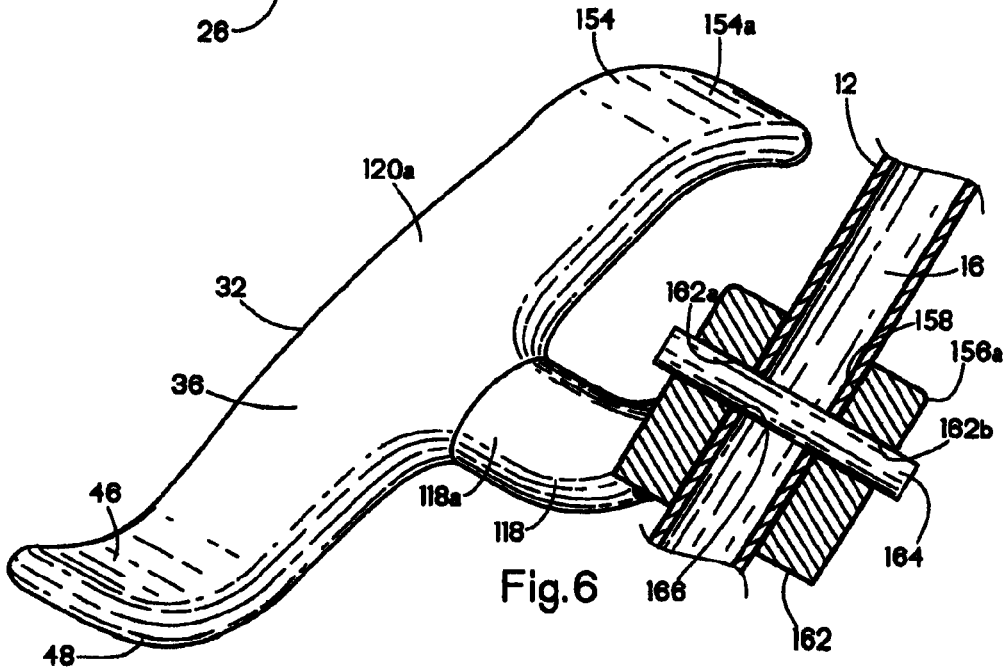
FIG. 6 is a partial section view of a paddle and a shaft of the mixer of FIG. 5.

Referring now to FIGS. 5-6, another alternate embodiment of the mixer 10, 50 is generally designated 150. Components shared with the mixer 10, 50 are designated with identical reference numbers. The mixer 150 has its paddles 154 preferably die cast in pairs and connected to a central collar 156 with a bore 158 (preferably non-circular) for receiving the shaft 12 to rotate the collar with the shaft. The main difference between the embodiments 50 and 150 is in the manner in which the paddles 154 are fastened to the shaft 12.

The collar 156 is made in two collar parts, 156*a*, 156*b*. Each collar part 156*a*, 156*b* is preferably associated with a pair of paddles 54 that disposed generally 180-degrees from each other. The collar parts 156*a*, 156*b* are stacked on top of each other forming the bore 158. The shaft 12 is introduced into the bore 158, and may protrude from a bottom surface 160 of the collar 156.

Each collar part 156*a*, 156*b* has a pair of apertures 162*a*, 162*b* to form a throughbore through the collar parts. The collar parts 156*a*, 156*b* are each secured to the shaft 12, preferably with a spring pin 164*a*, 164*b*. The spring pin 164 is introduced into a first aperture 162*a*, through a hole 166 through the shaft 12, and exits out the second aperture 162*b*. Alternately, the spring pin 164 can be a solid pin, can be threaded, or can be crimped or secured with a nut for additional holding power.

Preferably, a support arm 118 of each paddle 154 is curved. The support arms 118*a* of the collar 156*a* preferably curve downwardly and concavely away from the shaft 12 towards a blade portion 120*a*, and the support arms 118*b* of the collar 156*b* curve upwardly and convexly away from the shaft towards a blade portion 120*b* (where upward is the axial direction along the shaft away from the paddles 154). In this configuration, the blade portions 120*a*, 120*b* generally lay in the same plane despite the collars 156*a*, 156*b* being axially spaced on the shaft 12. In addition, the paddles 154 all have generally the same axial distance from the shaft end 16. Also, the collar parts 156*a*, 156*b* meet along a generally planar surface 162.

The present mixer 10, 50, 150 can break down the material to the appropriate amount of viscosity with little or no additional water. Further, since the mixer 10, 50, 150 is more efficient at folding the material, the user can reduce the amount of manual movement of the mixer, which in turn may reduce the amount of air entrainment into the mix. Additionally, the mixer 10, 50, 150 eliminates or significantly reduces the amount of vibration at the mixing container and at the mixer itself. In contrast to most conventional mixers, the mixer 10, 50, 150 can be operated with a single hand since less effort is required by the user. Further, it has been found that the mixer 10, 50, 150 can achieve the desired mixing up to 20 percent faster than some conventional mixers.

While particular embodiments of the present mixer 10 have been shown and described, it will be appreciated by those skilled in the art that changes and modifications may be made thereto without departing from the invention in its broader aspects and as set forth in the following claims.

The invention claimed is:

1. A mixer configured for attachment to a power tool for mixing a viscous material, comprising:

a shaft having a first end and defining a shaft axis;

a plurality of paddles attached to said shaft and extending radially from said shaft, all said paddles have generally the same axial distance to said first end of said shaft, said paddles configured for rotation about said shaft axis in a direction of rotation;

an outside surface of each paddle opposite said shaft, wherein said outside surface has a convex extension portion that runs less than a full length of said paddle, and said convex extension portion forms an outermost radial extent of the mixer;

each of said paddles having a general radiused "S"-shape defined between a top end and a bottom end of said paddle, and between a leading surface and a trailing surface of said paddle; and a support arm extending radially from said shaft to each of said paddles, said support arm forming a "T"-shape with each of said paddles, where said support arm forms a leg of said "T"-shape, and each of said paddles forms two arms of said "T"-shape; wherein said convex extension portion is in the same plane as the "T"-shape, and wherein an edge of said "S"-shape is in a plane 90-degrees from said "T"-shape.

2. The mixer of claim 1 wherein said top end of each said paddle curves toward the direction of rotation, and said bottom end curves away from the direction of rotation.

3. The mixer of claim 2 further comprising a generally linear portion between said top end and said bottom end.

4. The mixer of claim 1 wherein each said paddle has a pitch of about 0 to 30-degrees from the shaft axis.

5. The mixer of claim 4 wherein each said paddle has a pitch of about 15-degrees from said shaft axis.

6. The mixer of claim 1 further including four of said paddles spaced approximately 90° from each other in a plane transverse to the shaft axis.

7. The mixer of claim 1 further including a collar portion to which each said support arm is attached, and having a non-circular bore for receiving said shaft.

8. The mixer of claim 7 wherein said collar portion is made of two parts, each said part associated with a pair of said paddles projecting diametrically opposite each other.

9. The mixer of claim 8 wherein said collar portion is configured so that each said part has a complementary non-planar shape for preventing relative rotation of said parts.

10. The mixer of claim 1 wherein said outside surface of each paddle has a first portion on one side of said convex extension portion, and a second portion on a second side of said convex extension portion, wherein said convex extension portion has a greater radial extension from said shaft and is more curved than said first portion and said second portion of said outside surface.

11. A mixer configured for attachment to a power tool for mixing a viscous material, comprising:

a shaft having a first end and defining a shaft axis;

a hub attached to said shaft and concentric with said shaft axis, said hub forming said first end of said shaft;

a plurality of paddles attached to said hub, all said paddles having generally the same axial distance to said first end of said shaft, said paddles extending radially from said shaft axis and configured for rotation about said shaft axis in a direction of rotation;

said paddles each having an outside surface along the length of said paddle and opposite the shaft, said outside surface including a convex extension portion that forms an outermost radial extent of the mixer, wherein said outermost radial extent is less than a full length of said outside surface;

each of said paddles having a general radiused "S"-shape defined between a top end and a bottom end of said paddle, and between a leading surface and a trailing surface of said paddle;

each of said paddles having a first bottom surface forming the lowermost extent of the mixer, wherein said first bottom surface extends less than a full radial length of said paddle; and a support arm extending radially from said hub to each of said paddles, said support arm forming a "T"-shape with each of said paddles, where said support arm forms a leg of said "T"-shape, and each of said paddles forms two arms of said "T"-shape, wherein said convex extension portion is in the same plane as the "T"-shape, and wherein an edge of said "S"-shape is in a plane 90-degrees from said "T"-shape.

12. The mixer of claim 11 further comprising a top end of said paddle that curves toward the direction of rotation, and a bottom end that curves away from the direction of rotation.

13. The mixer of claim 12 further comprising a generally linear portion between said top end and said bottom end.

14. A mixer configured for attachment to a power tool for mixing a viscous material, comprising:

a shaft having a first end and defining a shaft axis;

a two-part collar attached to said shaft and concentric with said shaft axis, said two-part collar forming said first end of said shaft, each said collar part associated with a pair of said paddles which radially extend from said shaft axis diametrically opposite each other, and wherein said two-part collar is configured so that each said collar part has a complementary nonplanar edge face shape for preventing relative rotation of said parts upon assembly of said collar, wherein said nonplanar edge faces engage each other;

a plurality of identical paddles attached to said shaft and extending radially from said two-part collar, all said paddles have generally the same axial distance to said first end of said shaft, said paddles are configured for rotation about said shaft axis in a direction of rotation;

each of said paddles having a first bottom surface forming the lowermost extent of the mixer, wherein said first bottom surface extends less than a full radial length of said paddle;

an outside surface of each paddle opposite said shaft, wherein said outside surface has a convex extension portion that runs less than a full length of said paddle, and said convex extension portion forms an outermost radial extent of the mixer;

each of said paddles having a general radiused "S"-shape defined between a top end and a bottom end of said paddle, and between a leading surface and a trailing surface of said paddle;

support arms extending radially from said two-part collar to each of said paddles, said support arm forming a "T"-shape with each of said paddles, where said support arm forms a leg of said "T"-shape, and each of said paddles form two arms of said "T"-shape, wherein said convex extension portion is in the same plane as the "T"-shape, and wherein an edge of said "S"-shape is in a plane 90-degrees from said "T"-shape.

15. The mixer of claim 14 wherein each said paddle has a pitch of about 0 to 30-degrees from the shaft axis.

16. A mixer configured for attachment to a power tool for mixing a viscous material, comprising:

a shaft having a first end and defining a shaft axis;

a two-part collar attached to said shaft, said two-part collar concentric with said shaft axis, each said collar part associated with a pair of said paddles which radially extend from said shaft axis diametrically opposite each other, each said collar part pinned with a pin through said shaft;

a plurality of paddles attached to said shaft and extending radially from said shaft, said paddles configured for rotation about said shaft axis in a direction of rotation;

an outside surface of each paddle opposite said shaft, wherein said outside surface has a convex extension portion that runs less than a full length of said paddle, wherein said convex extension portion forms an outermost radial extent of the mixer, wherein said outside surface of each paddle has a first portion on one side of said convex extension portion, and a second portion on a second side of said convex extension portion, wherein said convex extension portion has a greater radial extension from said shaft and is more curved than said first portion and said second portion of said outside surface;

each of said paddles having a general radiused "S"-shape defined between a top end and a bottom end of said paddle, and between a leading surface and a trailing surface of said paddle; and support arms extending radially from each said collar part to each of said paddles, said support arm forming a "T"-shape with each of said paddles, where said support arm forms a leg of said "T"-shape, and each of said paddles form two arms of said "T"-shape, wherein said convex extension portion is in the same plane as the "T"-shape, and wherein an edge of said "S"-shape is in a plane 90-degrees from said "T"-shape.

17. The mixer of claim 16 wherein said two-part collar is fixed for rotation with said shaft.

* * * * *